United States Patent [19]

Matsui et al.

[11] Patent Number: 4,792,365

[45] Date of Patent: Dec. 20, 1988

[54] PRODUCTION OF BERYLLIUM-COPPER ALLOYS AND ALLOYS PRODUCED THEREBY

[75] Inventors: Yosuke Matsui, Handa; Shuhei Ishikawa, Yono; Takaharu Iwadachi, Handa, all of Japan

[73] Assignee: NGK Insulators, Ltd., Japan

[21] Appl. No.: 120,543

[22] Filed: Nov. 13, 1987

[30] Foreign Application Priority Data

Nov. 13, 1986 [JP] Japan ..... 61-268743
Nov. 13, 1986 [JP] Japan ..... 61-268744

[51] Int. Cl.[4] ..... C22F 1/08; C22C 9/06

[52] U.S. Cl. ..... 148/12.7 C; 148/435; 148/432; 148/2

[58] Field of Search ..... 148/2, 12.7 C, 11.5 C, 148/432, 433, 435, 436, 13.2; 420/485

[56] References Cited

U.S. PATENT DOCUMENTS

| | | | |
|---|---|---|---|
| 2,226,284 | 12/1940 | Harrington | 148/13.2 |
| 3,663,311 | 5/1972 | Chin et al. | 148/11.5 |
| 4,067,750 | 1/1978 | Mravic et al. | 148/2 |
| 4,179,314 | 12/1979 | Wikle | 148/12.7 C |
| 4,394,185 | 7/1983 | McClelland et al. | 148/11.5 |
| 4,425,168 | 1/1984 | Goldstein et al. | 148/2 |
| 4,541,875 | 9/1985 | Woodard et al. | 148/11.5 |
| 4,551,187 | 11/1985 | Church et al. | 148/432 |
| 4,565,586 | 1/1986 | Church et al. | 148/432 |
| 4,599,120 | 7/1986 | Church et al. | 148/432 |
| 4,657,601 | 4/1987 | Guha | 148/432 |
| 4,692,192 | 9/1987 | Ikushima et al. | 148/432 |

FOREIGN PATENT DOCUMENTS

| | | |
|---|---|---|
| 2554830 | 5/1985 | France . |
| 2566431 | 12/1985 | France . |

*Primary Examiner*—Deborah Yee
*Attorney, Agent, or Firm*—Parkhurst, Oliff & Berridge

[57] ABSTRACT

A process for producing beryllium-copper alloys is disclosed, which comprises the steps of obtaining a cast ingot by melting an alloy essentially consisting of from 0.05 to 2.0% by weight of Be, form 0.1 to 10.0% by weight of at least one kind of Co and Ni, and the balance being substantially Cu, subjecting the thus obtained cast ingot to a solution treatment at a temperature range from 800° to 1,000° C., cold working, annealing at a temperature range from 750° to 950° C. being lower than the solution treating temperature, and then an age hardening treatment. The alloy may further contain from 0.05 to 4.0% by weight of at least one kind of Si, Al, Mg, Zr, Sn, and Cr in a total amount. By this producing process, the beryllium-copper alloys having higher strength and formability can be otained due to uniform and fine dispersion of solid-unsolved precipitate.

12 Claims, 4 Drawing Sheets

800°C → 920°C 500 x

980°C → 920°C 500 x

800°C → 920°C 500 x

980°C → 920°C 500 x

PRODUCTION OF BERYLLIUM-COPPER ALLOYS AND ALLOYS PRODUCED THEREBY

BACKGROUND OF THE INVENTION (1) Field of the Invention

The present invention relates to beryllium-copper alloys which have high electrical conductivity and high strength and which are used as connectors, relays, etc. More particularly, the invention relates to a process for producing beryllium-copper alloys which possess excellent strength and formability due to the presence of finely dispersed solid-unsolved precipitate.

(2) Related Art Statement

A variety of beryllium-copper alloys have formerly widely been used as wrought materials for electronic parts, etc. making the most of their characteristics of high electrical conductivity and high strength. In the production of these beryllium-copper alloys, as shown in a flow chart of FIG. 3, a cast ingot consisting of Cu, Be and other auxiliary component or components is obtained, is subjected to a solution treatment, for instance, at 750° to 950° C., is cold worked, and then is age hardened, thereby obtaining a desired beryllium-copper alloy.

However, in the conventional production of the alloys mentioned above, the solution treatment is performed to improve strength and formability with a solid-unsolved intermetallic compound formed between Be and an auxiliary additive component or components. However, a great amount of coarse solid-unsolved precipitate of, for example, not less than 0.3 μm are recognized in the beryllium-copper alloys having undergone the above solution treatment. Thus, there is a problem that strength or formability cannot fully be improved.

By the way, strength can be increased in this case by solid-solving a part of the solid-unsolved precipitates through merely raising a solution treating temperature. However, since the grain size in a matrix simultaneously becomes greater, this technique has a defect that a great problem occurs in formability.

SUMMARY OF THE INVENTION

It is an object of the present invention to overcome the above-mentioned problems, and to provide a process for producing beryllium-copper alloys which have improved uniformity and increased strength and workability by making finer a large part of conventionally coarse solid-unsolved precipitate down to 0.3 μm or less and dispersing them into a matrix.

It is an another object of the present invention to provide a process for producing beryllium-copper alloys, which can attain high strength and formability by restraining grain growth during annealing due to the presence of solid-unsolved precipitate uniformly and finely dispersed in the matrix.

According to a first aspect of the present invention, there is a provision of a process for producing beryllium-copper alloys, which comprises the steps of obtaining a cast ingot essentially consisting of from 0.05 to 2.0% by weight of Be, from 0.1 to 10.0% by weight of at least one kind of Co and Ni, and the balanc being essentially Cu through melting, subjecting the cast ingot to a solution treatment at a temperature range from 800° to 1,000° C., cold working, annealing at a temperature range from 750° to 950° C. being lower than the solution treating temperature, and then an age hardening treatment.

According to a second aspect of the present invention, there is a provision of a process for producing beryllium-copper alloys, which comprises the steps of obtaining a cast ingot essentially consisting of from 0.05 to 2.0% by weight of Be, from 0.1 to 10.0% by weight of at least one kind of Co and Ni, from 0.05 to 4.0% by weight of at least one kind of Si, Al, Mg, Zr, Sn, and Cr, and the balance being essentially Cu throuh melting, and subjecting the cast ingot to a solution treatment at a temperature range from 800° to 1,000° C., cold working, an annealing treatment at a temperature range from 750° to 950° C. being lower than the solution treating temperature, and then an age hardening treatment.

These and other objects, features, and advantages of the present invention will be appreciated upon reading of the following description of the invention when taken in conjunction with the attached drawings, with the understanding that some modifications, variations, and changes of the same could be made by the skilled person in the art to which the invention pertains without departing from the spirit of the invention or the scope of claims appended hereto.

BRIEF DESCRIPTION OF THE ATTACHED DRAWINGS

For a better understanding of the invention, reference is made to the attached drawings, wherein:

FIG. 1 is a flow chart illustrating a process for producing beryllium-copper alloys according to the present invention;

FIGS. 2(*a*), (*b*), (*c*) and (*d*) are optical microscopic photographs of metallic structures of beryllium-copper alloys produced by a conventional process and by the invention process; and FIG. 3 is a flow chart illustrating an example of a conventional process for producing beryllium-copper alloys.

DETAILED DESCRIPTION OF THE INVENTION

In the present invention, a main reinforcing mechanism is precipitation of intermetallic compounds among Be and Co or Ni or further additives such as Si, Al, Mg, Zr, Sn and Cr. First, large precipitated grains are solid-solved into a matrix by the solution treatment at a temperature range from 800° to 1,000° C. higher than the conventional range so that precipitating nuclei may readily be formed by cold working. Then, a cold worked product is annealed in a temperature range from 750° to 950° C., which is lower than the solution treating temperature, preferably a difference between the annealing temperature and the solution treating temperature being in a range from 20° to 200° C., thereby obtaining an alloy in which a part of a solute is precipitated and consequently the grain size of precipitate of 0.3 μm or less is contained in an amount of not less than 40% by volume of all the precipitated grains in a dispersed state. When at least one kind of Si, Al, Mg, Zr, Sn and Cr is incorporated into the alloy, the percentage of the precipitate having the grain size of not more than 0.3 μm is not less than 50% by volume.

The reason why an addition amount of Be is limited to from 0.05 to 2.0% by weight is that if it is less than 0.05% by weight, an effect due to the addition cannot be obtained, while if it is more than 2.0% by weight, cost rises for improved strength. The addition amount is preferably from 0.1 to 0.7% by weight.

The reason why at least one kind of Co and Ni is limited to 0.1 to 10% by weight is that if it is less than 0.1% by weight, an effect due to the addition cannot be obtained, while if it is over 10.0% by weight, formability becomes poorer and further improvement in the properties cannot be expected. The addition amount is preferably from 0.2 to 4.0% by weight.

The reason why a total addition amount of at least one kind of Si, Al, Mg, Zr, Sn and Cr is limited to from 0.05 to 4.0% by weight is that if it is less than 0.05% by weight, an effect due to the addition cannot be obtained, while if it is over 4.0% by weight, formability becomes poorer and further improvement in the properties cannot be expected.

Furthermore, the reason why the solution treating temperature is limited to from 800° to 1,000° C. is that if it is less than 800° C., solid-solving of the precipitated grains does not proceed, while if it is over 1,000° C., the temperature becomes near or not less than a melting point of the alloy to render the production difficult.

The annealing temperature depends upon the solution treating temperature, the strength required, and the grain size of crystals. However, if the annealing temperature is less than 750° C., an amount of precipitates during the annealing becomes greater and the strength after the age hardening lowers, while if it is over 950° C., the precipitate amount becomes smaller so that a refining effect of the grains in the matrix is lost. Thus, the annealing temperature is limited to from 750° to 950° C.

Figure 1:
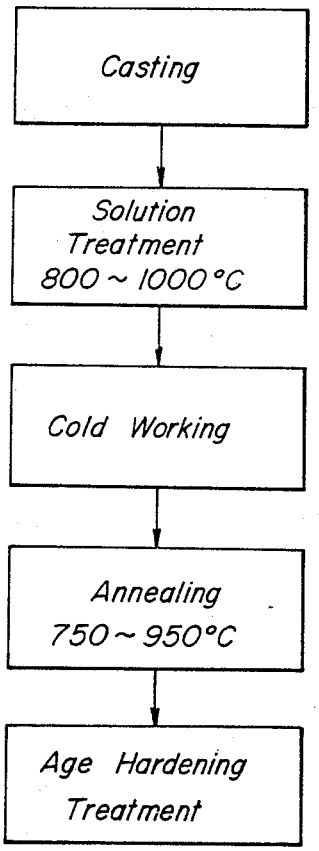
Figure 2A:
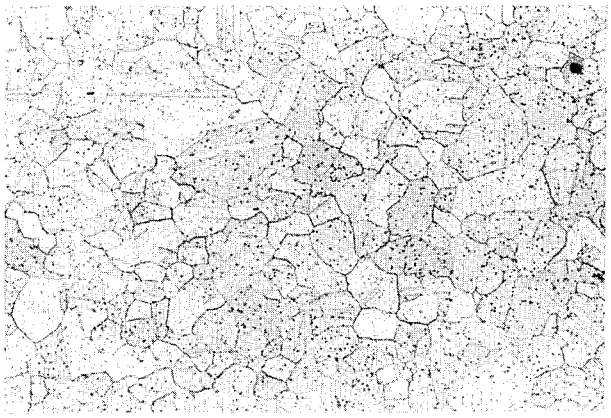
Figure 2B:
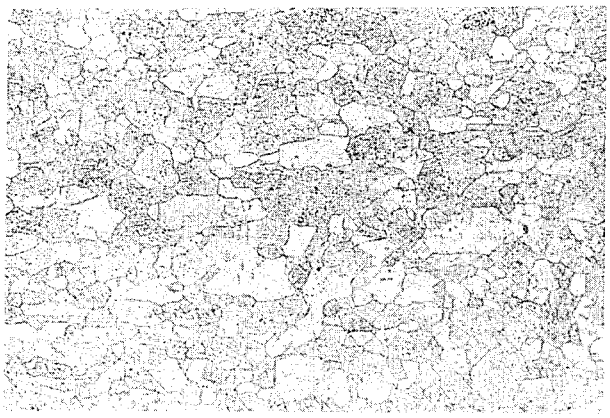
Figure 2C:
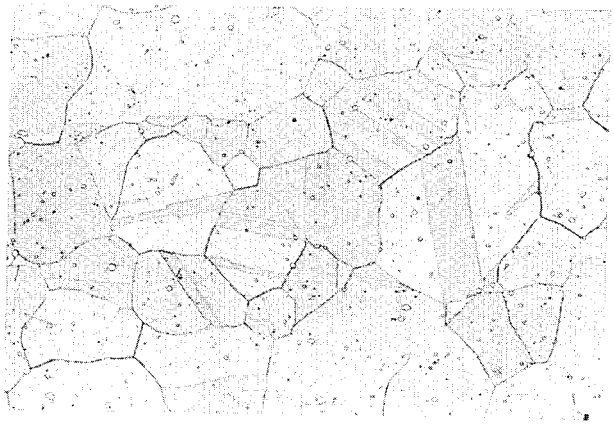
Figure 2D:
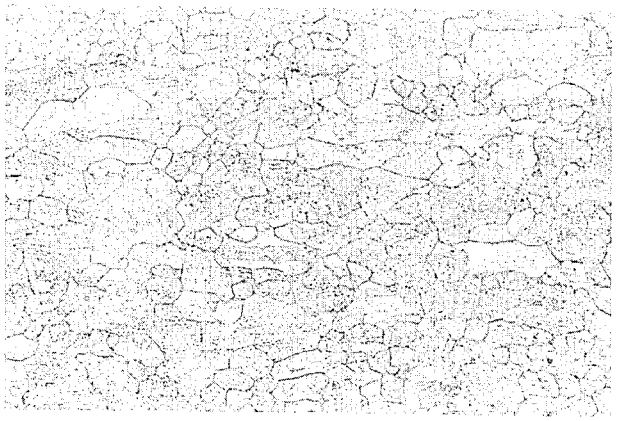
Figure 3:
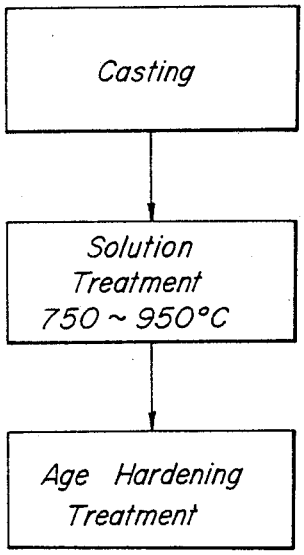
FIG 3 PRIOR ART

FIG. 1 is a flow chart illustrating a process for producing beryllium-copper alloys according to the present invention. In this example, an alloy essentially consisting of from 0.05 to 2.0% by weight of Be, from 0.1 to 10.0% by weight of at least one kind of Co and Ni, and if necessary, from 0.05 to 4.0% by weight of at least one kind of Si, Al, Mg, Zr, Sn, and Cr, and the balance being essentially Cu is cast, thereby obtaining a cast ingot. The thus obtained cast ingot is hot forged, and repeatedly cold rolled and annealed for refining, thereby obtaining a raw product. This primary product is then subjected to a solution treatment at a given temperature range from 800° to 1,000° C., and is cold worked to obtain a desired shape, which is subjected to an annealing treatment at a temperature range from 750° to 950° C. lower than the solution treating temperature, preferably lower by from 20° to 200° C., desirably for 1 to 5 minutes. Finally, the resulting product is subjected to an ordinary age hardening treatment, thereby obtaining a beryllium-copper alloy material having various properties falling inside the present invention.

In the following, specific examples of the present invention will be explained. The invention as a matter of course should never be interpreted to be limited to these Examples. They are merely given in illustration of the invention.

Alloys having various compositions shown in Table 1 were cast, hot forged, and further repeatedly cold rolled and annealed, which were each divided into three pieces. Then, one of the groups was subjected to the solution treatment at temperatures shown in Table 1 according to the invention process (Sample Nos. 1–9, and 101 to 110). Another group was subjected to a solution treatment at an ordinary solution treating temperatures shown in Table 1 according to a conventional process (Sample Nos. 10–18 and 111–120). The other group was treated, only the solution treatment being effected at the same temperatures in Examples according to the present invention (Sample Nos. 19–27 and 121–130). In each group, the solution treatment was effected for 5 minutes. The invention alloys (Nos. 1–9 and 101 to 110) were then annealed at temperatures shown in Table 1, and cold rolled at 30%.

Thereafter, with respect to each of the samples, a value R/t as a safety bending factor was determined by dividing a minimum radius of curvature, "R", at which the sample could be bent at 90° in a direction orthogonal to a rolling direction without being cracked by a thickness "t" of the sample.

With respect to the invention alloys (No. 1–9 and 101–110) and the conventionally solution treated materials (No. 10–18 and 111–120), tensile strength and fatigue strength (under a stress of 60 kg/mm$^2$) after an ordinary age hardening treatment were measured.

In addition, in order to examine influences of the annealing temperatures in the present invention, alloys (Nos. 28, 29, 131 and 132) were solution treated at a temperature inside the scope of the present invention and annealed at annealing temperatures outside the scope of the invention, and their properties were measured.

Results are shown in Tables 1 and 2. In Table 1, the grain size of the matrix and a percentage of precipitated grains having not more than 0.3 μm were visually determined based on an optical microscopic photograph at an equal magnification.

TABLE 1(a)

| | Sample No. | Composition (wt %) Be | Co | Ni | Cu | Solution treatment (°C.) | Annealing temperature (°C.) | Precipitated grains of not more than 0.3 μm (% by volume) | Grain size of matrix (μm) | Tensile strength (kg/mm$^2$) | Formability (R/t) | Fatigue strength (× 10$^3$) |
|---|---|---|---|---|---|---|---|---|---|---|---|---|
| Invention alloys | 1 | 0.2 | — | 0.7 | remainder | 980 | 800 | 80 | 20 | 55 | 0.5 | 80 |
| | 2 | 0.2 | 1.0 | — | remainder | 980 | 800 | 80 | 15 | 57 | 0.5 | 80 |
| | 3 | 0.5 | — | 3.0 | remainder | 980 | 900 | 70 | 7 | 85 | 0.8 | 100 |
| | 4 | 0.5 | 2.5 | — | remainder | 980 | 900 | 70 | 7 | 90 | 0.8 | 110 |
| | 5 | 0.8 | — | 4.0 | remainder | 950 | 900 | 50 | 5 | 92 | 1.0 | 150 |
| | 6 | 0.8 | 3.5 | — | remainder | 950 | 900 | 50 | 6 | 93 | 1.0 | 140 |
| | 7 | 1.3 | 3.0 | — | remainder | 900 | 800 | 45 | 7 | 108 | 1.5 | 200 |
| | 8 | 1.3 | — | 5.0 | remainder | 900 | 800 | 45 | 6 | 112 | 1.5 | 220 |
| | 9 | 0.5 | 2.5 | 2.5 | remainder | 950 | 920 | 60 | 7 | 90 | 0.8 | 180 |
| Conventional alloys | 10 | 0.2 | — | 0.7 | remainder | 800 | — | <10 | 30 | 53 | 0.8 | 50 |
| | 11 | 0.2 | 1.0 | — | remainder | 800 | — | <10 | 30 | 55 | 0.8 | 60 |
| | 12 | 0.5 | — | 3.0 | remainder | 900 | — | <10 | 15 | 80 | 1.2 | 70 |
| | 13 | 0.5 | 2.5 | — | remainder | 900 | — | <10 | 15 | 84 | 1.2 | 100 |
| | 14 | 0.8 | — | 4.0 | remainder | 900 | — | <10 | 12 | 88 | 1.5 | 100 |
| | 15 | 0.8 | 3.5 | — | remainder | 900 | — | <10 | 10 | 90 | 1.5 | 70 |

TABLE 1(a)-continued

| | Sample No. | Composition (wt %) Be | Co | Ni | Cu | Solution treatment (°C.) | Annealing temperature (°C.) | Precipitated grains of not more than 0.3 μm (% by volume) | Grain size of matrix (μm) | Tensile strength (kg/mm²) | Formability (R/t) | Fatigue strength (× 10³) |
|---|---|---|---|---|---|---|---|---|---|---|---|---|
| | 16 | 1.3 | 3.0 | — | remainder | 800 | — | <10 | 10 | 107 | 1.8 | 150 |
| | 17 | 1.3 | — | 5.0 | remainder | 800 | — | <10 | 9 | 106 | 1.8 | 200 |
| | 18 | 0.5 | 2.5 | 2.5 | remainder | 920 | — | <10 | 15 | 83 | 1.5 | 80 |

TABLE 1(b)

| | Sample No. | Composition (wt %) Be | Co | Ni | Cu | Solution treatment (°C.) | Annealing temperature (°C.) | Precipitated grains of not more than 0.3 μm (% by volume) | Grain size of matrix (μm) | Tensile strength (kg/mm²) | Formability (R/t) | Fatigue strength (× 10³) |
|---|---|---|---|---|---|---|---|---|---|---|---|---|
| Comparative alloys | 19 | 0.2 | — | 0.7 | remainder | 980 | — | <5 | 200 | — | 4 | — |
| | 20 | 0.2 | 1.0 | — | remainder | 980 | — | <5 | 200 | — | 3 | — |
| | 21 | 0.5 | — | 3.0 | remainder | 980 | — | <5 | 80 | — | 3 | — |
| | 22 | 0.5 | 2.5 | — | remainder | 980 | — | <5 | 100 | — | 3 | — |
| | 23 | 0.8 | — | 4.0 | remainder | 950 | — | <5 | 25 | — | 2 | — |
| | 24 | 0.8 | 3.5 | — | remainder | 950 | — | <5 | 30 | — | 2 | — |
| | 25 | 1.3 | 3.0 | — | remainder | 900 | — | <5 | 40 | — | 3 | — |
| | 26 | 1.3 | — | 5.0 | remainder | 900 | — | <5 | 30 | — | 3 | — |
| | 27 | 0.5 | 2.5 | 2.5 | remainder | 950 | — | <5 | 80 | — | 3 | — |
| | 28 | 0.5 | — | 3.0 | remainder | 980 | 700 | 30 | 5 | 50 | 0.5 | — |
| | 29 | 0.5 | 2.5 | 2.5 | remainder | 1000 | 1000 | 5 | 100 | 107 | 3 | — |

TABLE 2(a)

| | Sample No. | Composition (wt %) Be | Co | Ni | Other | Cu | Solution treatment (°C.) | Annealing temperature (°C.) | Precipitated grains of not more than 0.3 μm (% by volume) | Grain size of matrix (μm) | Tensile strength (kg/mm²) | Formability (R/t) | Fatigue strength (× 10³) |
|---|---|---|---|---|---|---|---|---|---|---|---|---|---|
| Invention alloys | 101 | 0.2 | — | 2.0 | 0.5 Si | remainder | 980 | 900 | 90 | 14 | 63 | 0.5 | 90 |
| | 102 | 0.2 | 1.0 | — | 1.0 Al | remainder | 980 | 900 | 80 | 20 | 71 | 0.5 | 100 |
| | 103 | 0.2 | — | 2.0 | 0.1 Mg | remainder | 980 | 900 | 80 | 15 | 62 | 0.5 | 120 |
| | 104 | 0.2 | 2.0 | — | 0.4 Zr | remainder | 980 | 900 | 80 | 15 | 68 | 0.5 | 150 |
| | 105 | 0.3 | — | 3.0 | 0.4 Sn | remainder | 980 | 900 | 70 | 15 | 74 | 1.0 | 200 |
| | 106 | 0.3 | 3.0 | — | 0.4 Cr | remainder | 980 | 900 | 70 | 14 | 75 | 1.0 | 180 |
| | 107 | 0.6 | — | 3.5 | 0.7 Si | remainder | 970 | 900 | 60 | 10 | 88 | 2.0 | 180 |
| | 108 | 0.7 | 3.0 | — | 1.0 Al | remainder | 970 | 900 | 60 | 8 | 93 | 1.5 | 200 |
| | 109 | 1.3 | 4.0 | 3.5 | 0.2 Mg | remainder | 850 | 750 | 50 | 10 | 102 | 1.0 | 180 |
| | 110 | 1.5 | — | 8.0 | 1.0 Al 0.4 Zr | remainder | 850 | 750 | 50 | 15 | 107 | 1.0 | 170 |

TABLE 2(b)

| | Sample No. | Composition (wt %) Be | Co | Ni | Other | Cu | Solution treatment (°C.) | Annealing temperature (°C.) | Precipitated grains of not more than 0.3 μm (% by volume) | Grain size of matrix (μm) | Tensile strength (kg/mm²) | Formability (R/t) | Fatigue strength (× 10³) |
|---|---|---|---|---|---|---|---|---|---|---|---|---|---|
| Conventional alloys | 111 | 0.2 | — | 2.0 | 0.5 Si | remainder | 900 | — | <10 | 25 | 58 | 0.8 | 50 |
| | 112 | 0.2 | 1.0 | — | 1.0 Al | remainder | 900 | — | <10 | 30 | 70 | 0.8 | 60 |
| | 113 | 0.2 | — | 2.0 | 0.1 Mg | remainder | 900 | — | <10 | 30 | 57 | 0.8 | 60 |
| | 114 | 0.2 | 2.0 | — | 0.4 Zr | remainder | 900 | — | <10 | 25 | 64 | 0.8 | 80 |
| | 115 | 0.3 | — | 3.0 | 0.4 Sn | remainder | 900 | — | <10 | 30 | 71 | 1.5 | 100 |
| | 116 | 0.3 | 3.0 | — | 0.4 Cr | remainder | 900 | — | <10 | 20 | 70 | 1.5 | 150 |
| | 117 | 0.6 | — | 3.5 | 0.7 Si | remainder | 900 | — | <10 | 15 | 83 | 2.5 | 150 |
| | 118 | 0.7 | 3.0 | — | 1.0 Al | remainder | 900 | — | <10 | 18 | 89 | 2.0 | 150 |
| | 119 | 1.3 | 4.0 | 3.5 | 0.2 Mg | remainder | 750 | — | <10 | 15 | 96 | 1.5 | 150 |
| | 120 | 1.5 | — | 8.0 | 1.0 Al 0.4 Zr | remainder | 750 | — | <10 | 20 | 100 | 1.5 | 140 |

TABLE 2(c)

| | Sample No. | Composition (wt %) Be | Co | Ni | Other | Cu | Solution treatment (°C.) | Annealing temperature (°C.) | Precipitated grains of not more than 0.3 μm (% by volume) | Grain size of matrix (μm) | Tensile strength (kg/mm²) | Formability (R/t) | Fatigue strength (× 10³) |
|---|---|---|---|---|---|---|---|---|---|---|---|---|---|
| Comparative | 121 | 0.2 | — | 2.0 | 0.5 Si | remainder | 980 | — | <5 | 80 | — | 3 | — |
| | 122 | 0.2 | 1.0 | — | 1.0 Al | remainder | 980 | — | <5 | 100 | — | 4 | — |

TABLE 2(c)-continued

| | Sample No. | Composition (wt %) Be | Co | Ni | Other | Cu | Solution treatment (°C.) | Annealing temperature (°C.) | Precipitated grains of not more than 0.3 μm (% by volume) | Grain size of matrix (μm) | Tensile strength (kg/mm²) | Formability (R/t) | Fatigue strength (× 10³) |
|---|---|---|---|---|---|---|---|---|---|---|---|---|---|
| ative alloys | 123 | 0.2 | — | 2.0 | 0.1 Mg | remainder | 980 | — | <5 | 75 | — | 3 | — |
| | 124 | 0.2 | 2.0 | — | 0.4 Zr | remainder | 980 | — | <5 | 70 | — | 2 | — |
| | 125 | 0.3 | — | 3.0 | 0.4 Sn | remainder | 980 | — | <5 | 50 | — | 3 | — |
| | 126 | 0.3 | 3.0 | — | 0.4 Cr | remainder | 980 | — | <5 | 50 | — | 3 | — |
| | 127 | 0.6 | — | 3.5 | 0.7 Si | remainder | 970 | — | <5 | 30 | — | 3 | — |
| | 128 | 0.7 | 3.0 | — | 1.0 Al | remainder | 970 | — | <5 | 40 | — | 3 | — |
| | 129 | 1.3 | 4.0 | 3.5 | 0.2 Mg | remainder | 850 | — | <5 | 20 | — | 2 | — |
| | 130 | 1.5 | — | 8.0 | 1.0 Al 0.4 Zr | remainder | 850 | — | <5 | 40 | — | 2 | — |
| | 131 | 0.6 | — | 1.0 | 1.0 Al | remainder | 900 | 700 | 40 | 5 | 52 | 0.5 | — |
| | 132 | 0.6 | 8.0 | 7.0 | 1.0 Si | remainder | 900 | 1000 | <5 | 120 | 103 | 4 | — |

As obvious from results in Tables 1 and 2, the alloys according to the present invention (Nos. 1–9 and 101–110) which underwent the solution treatment at the temperature range from 800° to 1,000° C., cold working, the annealing at the temperature range from 750° to 950° C. lower than the solution treating temperature, and then the age hardening have a smaller grain size of the matrix as compared with the conventional alloys and comparative llloys, the percentages of the precipitated grains having not more than 0.3 μm being not less than 40% by volume (Nos. 1–9) or not less than 50% by volume (Nos. 101–110). As a result, it is seen that excellent tensile strength, formability, and fatigue resistance could be obtained.

FIGS. 2(*a*) through (*b*) are optical microscopic photographs showing metallic structures of the beryllium-copper alloys each consisting of Cu-0.4 Be-2.0 Ni produced according to the conventional process and the invention process, respectively. FIGS. 2(*c*) and (*d*) are optical microscopic photographs of beryllium-copper alloys each consisting of Cu-0.2 Be-2.5 Ni-0.6 Si prodcced according to the conventional process and the invention process, respectively. As obvious from FIGS. 2(*a*) through (*d*), in the alloys according to the present invention, the grains of the matrix are finer and the precipitate composed of the intermetallic compounds are finely dispersed.

As obvious from the aforegoing description, according to the process for producing the beryllium-copper alloys in the present invention, the alloys composed of given compositions are solution treated at a temperature range from 800° to 1,000° C. higher than the conventional range to solid-solve the large precipitated grains into the matrix, cold worked so that the precipitating nuclei may readily be formed, and annealed at a temperature range from 750° to 950° C. lower than the solution treating temperature, preferably the difference between the annealing temperature and the solution treating temperature being from 20° to 200° C. Thereby, the alloys can be obtained, in which a part of a solute is precipitated so that the percentage of the precipitated grains having the grain size of not more than 0.3 μm is not less than 40% by volume (when at least one kind of Si, Al, Mg, Zr, Sn or Cr is not included) or not less than 50% by volume (when at least one kind of Si, Al, Mg, Zr, Sn and Cr is included) in a dispersed state.

Consequently, the alloys obtained according to the producing process of the present invention can afford the beryllium-copper alloys which have improved tensile strength, formability, and fatigue strength and are a favorably applied as spring materials, electrical parts such as connectors, etc., which are required to have high conductivity and strength.

What is claimed is:

1. A process for producing beryllium-copper alloys, which comprises the steps of obtaining a cast ingot by melting an alloy comprising of from 0.05 to 2.0% by weight of Be, from 0.1 to 10.0% by weight of at least one kind of Co ad Ni, and the balance being substantially Cu, subjecting the thus obtained cast ingot to a solution treatment at a temperature range from 800° to 1,000° C., cold working, annealing at a temperature range from 750° to 950° C. said annealing temperature being lower than the solution treating temperature, and then an age hardening treatment, such that the difference between the solution treating temperature and the annealing temperature is in a range from 20° to 200° C.

2. A process for producing beryllium-copper alloys according to claim 1, wherein the alloy further contains from 0.05 to 4.0% by weight of at least one kind of Si, Al, Mg, Zr, Sn and Cr in a total amount.

3. A process for producing beryllium-copper alloys according to claim 1, wherein a percentage of precipitated grains having a grain size of not more than 0.3 μm is not less than 40% by volume in the obtained alloy.

4. A process for producing beryllium-copper alloys according to claim 2, wherein a percentage of precipitated grains having a grain size of not more than 0.3 μm is not less than 50% by volume in the obtained alloy.

5. A process for producing beryllium-copper alloys according to claim 1, wherein Be is in a range from 0.1 to 0.7% by weight.

6. A process for producing beryllium-copper alloys according to claim 2, wherein Be is in a range from 0.1 to 0.7% by weight.

7. A process for producing beryllium-copper alloys according to claim 1, wherein at least one kind of Co and Ni is in a range from 0.2 to 4.0% by weight.

8. A process for producing beryllium-copper alloys according to claim 2, wherein at least one kind of Co and Ni is in a range from 0.2 to 4.0% by weight.

9. A copper-beryllium alloy produced by the process of claim 1.

10. The copper-beryllium alloy of claim 9 wherein the percentage of precipitated grains having a grain size of not more than 0.3 microns is not less than 40% by volume of the alloy.

11. A copper-beryllium alloy produced by the process of claim 2.

12. The copper-beryllium alloy of claim 11 wherein the percentage of precipitated grains having a grain size of not more than 0.3 microns is not less than 40% by volume of the alloy.

* * * * *